US005954589A

United States Patent [19]

Masters

[11] Patent Number: 5,954,589

[45] Date of Patent: Sep. 21, 1999

[54] CUE REST FOR CLAMPING ON A TABLE EDGE

[75] Inventor: Michael T. Masters, Winnipeg, Canada

[73] Assignee: Kegus Investments Ltd., Winnipeg, Canada

[21] Appl. No.: 08/992,120

[22] Filed: Dec. 17, 1997

[51] Int. Cl.[6] ..... A63D 15/10

[52] U.S. Cl. ..... 473/42

[58] Field of Search ..... 473/42, 43

[56] References Cited

U.S. PATENT DOCUMENTS

| | | | |
|---|---|---|---|
| 4,120,495 | 10/1978 | Moughler | 473/43 |
| 5,165,681 | 11/1992 | Enger | 473/43 |
| 5,449,325 | 9/1995 | Dransfield | 473/43 |

*Primary Examiner*—Theatrice Brown
*Attorney, Agent, or Firm*—Adrian D. Battison; Murray E. Thrift

[57] ABSTRACT

A cue rest for attachment to a suitable support such as the table top includes two opposed jaws with jaw surfaces for engaging opposed sides of the support. The jaws are connected for relative pivotal movement and are spring biased to the clamping position. Each jaw has a manually engageable portion on a side of the pivot axis opposite to the jaw surface and arranged such that the jaws can be moved to the release position by manual squeezing of the manually engageable portions. A generally U-shaped receiving surface is provided on at least one and preferably both of the jaw members, the receiving surface defining an open mouth at an edge of the manually engageable portion opposite to the jaw surfaces for receiving and cradling the cue within the receiving surface.

11 Claims, 3 Drawing Sheets

CUE REST FOR CLAMPING ON A TABLE EDGE

This invention relates to a cue rest of a type which can be damped onto a table edge and which provides a receiving surface against which a cue can be rested.

BACKGROUND OF THE INVENTION

Players of games such as billiards, snooker and pool all use a cue which, for players of any skill, requires careful protection to ensure particularly that the sliding surfaces adjacent the tip of the cue are maintained smooth and accurate.

Pool halls which are particularly designed for these games often have a rack which allows the cue to be stored in a carefully protected location to avoid possibility of it being knocked or dropped.

However in recent years the game has expanded to many other locations which are not properly equipped with the racks. Thus the player often has to resort to simply leaning the cue against a side of the table when not in use. This can lead to the cue being knocked and, as it is not properly restrained, it can fall to the ground with the danger of scuffing, denting or marking the sliding surfaces.

One device has been proposed for solving this problem which provides a metal base with a screw clamp at one side. The screw clamp simply comprises a threaded pin which is rotated manually to drive a head at the end of the pin into engagement with a suitable surface on the table. On the exposed face of the device away from the table is provided a moulded receptacle of a foam material which is bonded onto the metal base. While this device goes someway toward solving the problem, the device proposed is unsatisfactory from a practical point of view. Firstly the screw clamp is difficult to apply so that it cannot be applied and removed quickly. The device is therefore more of a permanent nature but this may be unsatisfactory since it can be located in an area which causes the device to interfere with proper access. Secondly the screw clamp requires the pinching effect of the head of the screw which can mar the table. Thirdly the foam material can rapidly break down and break away from the metal base so that the device is unsatisfactory for repeated or extended use.

SUMMARY OF THE INVENTION

It is one object of the present invention, therefore, to provide an improved cue rest of a type which can be rapidly attached to and removed from a suitable supporting surface such as a table and provides a receptacle for the cue to rest the cue in a secure position.

According to the invention there is provided a cue rest comprising: a first jaw member defining a first jaw surface for engaging one side of a support member;

a second jaw member defining a second jaw surface for engaging an opposed side of the support member; the first and second jaw members being connected for relative pivotal movement about an axis parallel to the jaw surfaces so as to be movable from a clamping position engaging the support member in a direction to increase the spacing between the jaw surfaces to release the support member; a spring biasing the jaw members to the clamping position; each jaw member having a manually engageable portion on a side of the pivot axis opposite to the jaw surface and arranged such that the jaw members can be moved to the release position by manual squeezing of the manually engageable portions; and a generally U shaped receiving surface on at least one of the jaw members, the receiving surface including two sides and a base with an open mouth at one edge of said at least one jaw member for receiving and cradling the cue within the receiving surface.

Preferably the receiving surface is located at a suitable position in the manually engageable portion of said at least one of the jaw members which can be at the rear edge but could also be at other locations around the portion.

Preferably the manually engageable portion has a wall portion generally parallel to the jaw surface such that with the jaw surface engaging a horizontal support member the wall portion is horizontal with the receiving surface at one edge.

Preferably the wall portion is of constant thickness with a top surface and a bottom surface both of which are substantially horizontal.

Preferably the receiving surface is arranged in the edge of the at least one jaw member, which edge faces away from the pivot axis.

Preferably each of the jaw members has a receiving surface therein with the receiving surfaces being vertically aligned to receive the cue in vertical orientation.

Preferably each jaw member comprises a substantially horizontal plate having the jaw surface at one end and the manually engageable portion at the opposed end and wherein each plate includes a pair of side walls extending at right angles to the plate, the side walls of one plate having overlapping parts relative to the side walls of the other plate for defining the pivot axis between the overlapping parts and parallel to the plates.

Preferably the depending sides are aligned with parts of reduced thickness overlapped.

Preferably the plates are substantially identical in plan view and are aligned so that one directly overlies the other.

Preferably the receiving surface forms an arc of a circle extending over an angle greater than 180°.

Preferably the receiving surface is dimensioned such that the cue is a loose fit therein.

Preferably the receiving surface has a layer of a resilient material for engaging the cue.

Preferably so at least one of the jaw members has two receiving surfaces arranged side by side for receiving two cues side by side.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
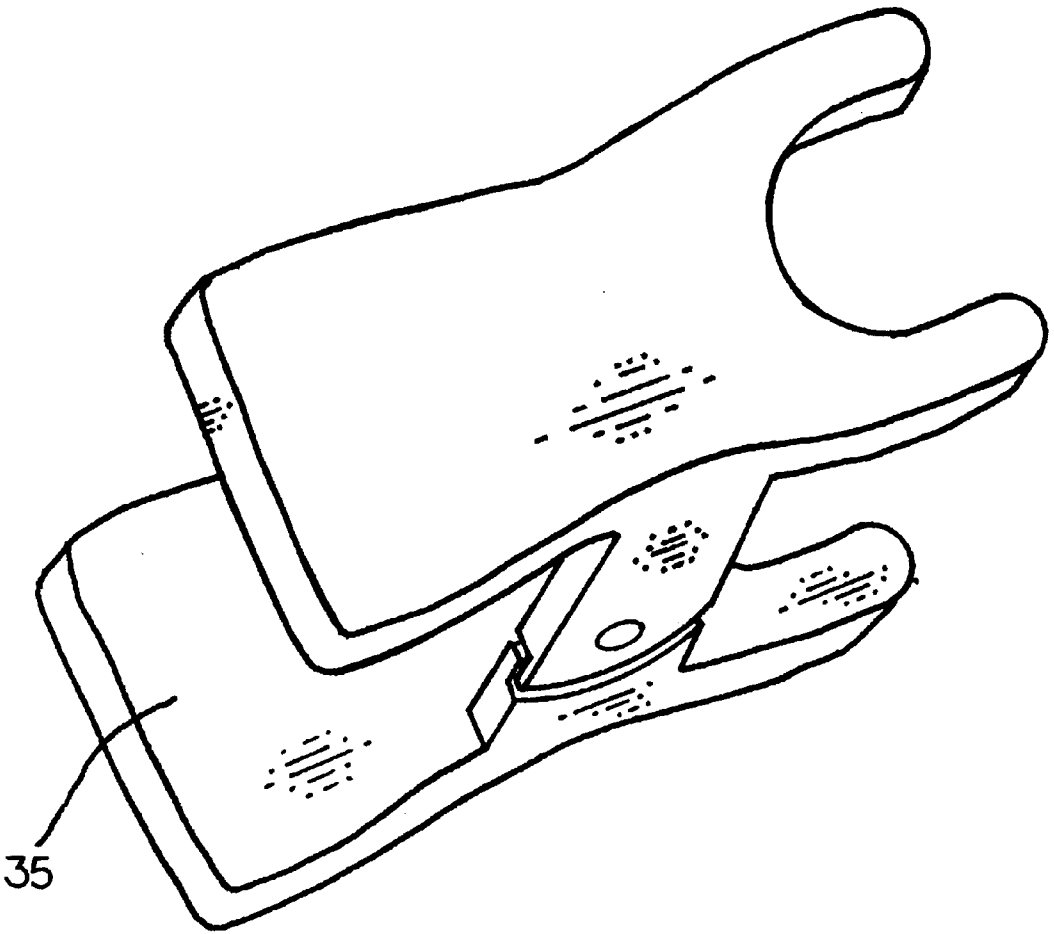
FIG. 1 is an isometric view of the cue rest according to the present invention.
Figure 2:
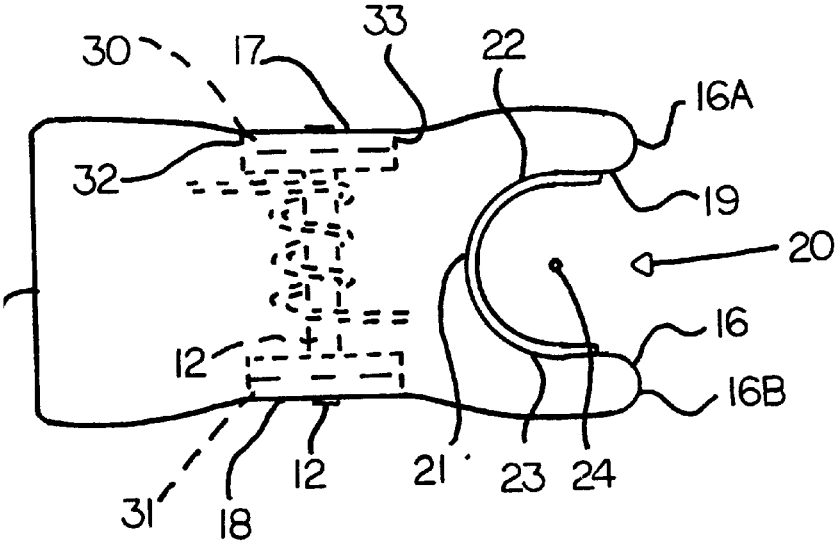
FIG. 2 is a top plan view of the cue rest of FIG. 1.

The following description uses terms for describing the parts of the device and their relative location which relate to the device in its normal operating orientation as shown in the drawings, although it will be appreciated that the device can be rotated to other orientations in which the terms may no longer be applicable.

The cue rest as illustrated in FIGS. 1 through 4 comprises a first jaw member 10 and a second jaw member 11 which are mounted for pivotal movement about a transverse pivot pin 12. The jaw members are substantially identical and arranged in directly overlying position. Each jaw member comprises a horizontal plate 13 with a substantially planar top surface 14 and a substantially planar bottom surface 15 spaced by the thickness of the plate 13. In plan view the plate is substantially rectangular so as to define a forward edge 15, a rearward edge 16 and two side edges 17 and 18. The side edges are slightly concave so that the width of the plate is slightly less at the centre adjacent the pivot pin 12 then at the forward and rearward edges. The forward edge 15 is slightly convex. Each of the corners is smoothly rounded so as to provide an attractive appearance.

At the rear edge of each plate is provided a receiving surface 19 which is cut through the thickness of the plate so as to define an open mouth 20, a base 21 opposite the open mouth and two sides 22 and 23. The base 21 and the sides 22 and 23 form a smoothly curved shape which is substantially part circular and extending over an angle greater than 180° such that the sides converge inwardly. Thus the open mouth 20 is slightly narrower than the maximum width between the sides which occurs at the centre 24 of the part circular shape. The sides 22 and 23 smoothly curve into the end surface 16 which forms thus two separate end surface portions 16A and 16B defining in effect a pair of lobes. Thus the surface is rounded or smoothly curved from the sides 22 around the lobes defined by the surface portion 16A and 16B and onto the sides 17 and 18.

The receiving surface may also carry a thin layer of a resilient material to avoid marring the surface of the cue. However the receiving surface is formed substantially wholly by the material of the jaw members which is a molded plastics material and is substantially rigid since it accepts the forces necessary for opening and closing the jaws as they clamp the surface. The receiving surface is therefore resistant to damage by repeated insertion of the cue.

The plate carries two depending side walls 30 and 31 which lie at right angles to the plate each at a respective side edge of the plate. The walls 30 and 31 extend forwardly from the pivot pin 12 to a front edge 32 which is spaced rearwardly of the forward edge 15 of the plate. The walls extend rearwardly to a rear edge 33 which is spaced forwardly of the rear edge 16 of the plate. Thus each plate has a jaw surface 35 defined rearwardly of the front edge 15 and in front of the edges 32 which can clamp onto the top and bottom surfaces respectively of a suitable member located therebetween. The location of the side walls ensures that the side walls are spaced from the receiving surface 19.

Figure 4:
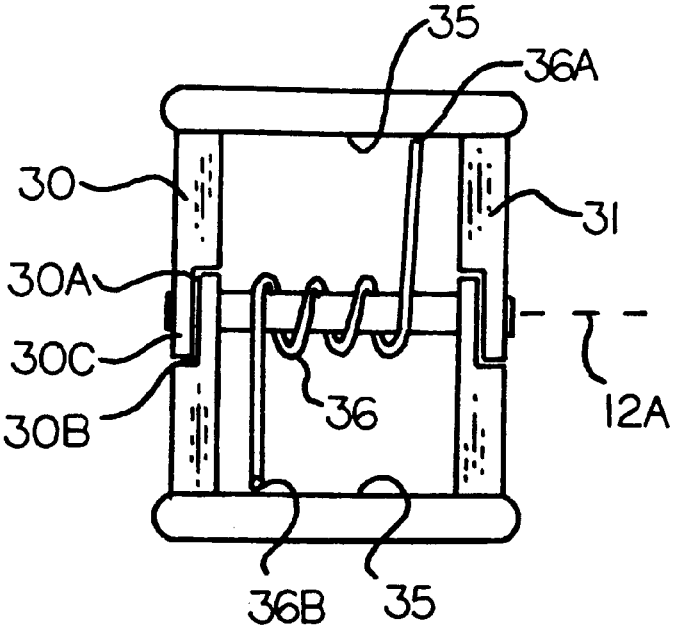
FIG. 4 is an end elevational view of the cue rest of FIG. 1.

The walls 31 and 32 thus are directly aligned one on top of the other as best shown in FIG. 4. However the wall of the upper plate includes a recessed section 30A on the inside surface thereof and the wall of the bottom plate includes recessed section 30B on the outside surface thereof so that the walls can overlap at the recessed sections. The overlapping portions 30A and 30B have a hole 30C for the pin 12 so that the pin passes through the overlapping sections and allows pivotal movement of the two plates relative to each other to occur around the axis 12A of the pin. A spring 36 is mounted on the pin and wraps around the pin with two end portions 36A and 36B engaging respective ones of the jaw members so as to close the jaw member in a direction to provide a clamping action between the jaw surfaces 35.

The top or outer surfaces of the jaw members are substantially smooth and flat. Also the bottom surfaces are generally smooth and flat so that the clamping surfaces 35 are also flat. However these may have slight raised ribs for additional grip or may include an applied layer of a resilient material to avoid marring of the surface to which the clamping jaws are attached.

In operation, the cue rest is relatively small and compact and therefore can be carried simply in the pocket of the user. Its size is not significantly greater than that of a paper type clip. The product is manufactured from a suitable moulded plastics which provides smooth attractive surfaces.

Figure 3:
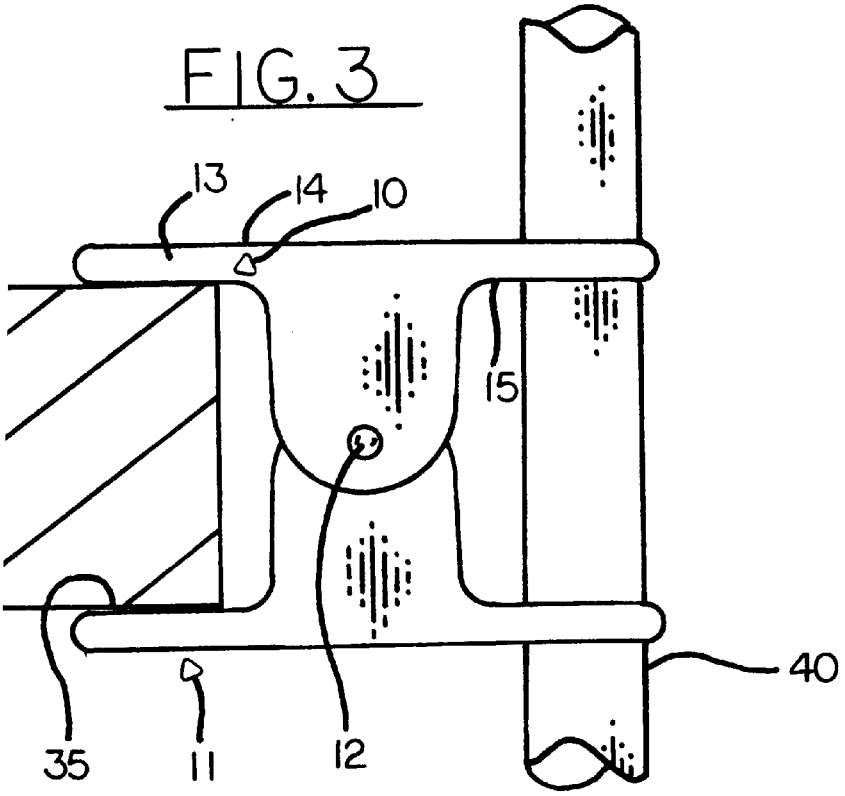
FIG. 3 is a side elevational view of a cue rest of FIG. 1.

The device can therefore be readily removed from the pocket and attached to a suitable table edge by pressure on the rear ends of the jaw members squeezing them together to open the jaw surfaces. The spring holds the device onto the table edge with the rear edge 16 exposed away from the table edge. A cue 40 can then be rested in the receiving surface with the cue being received as a loose fit inside the part circular shape defined by the base and sides of the receiving surface. The cue engages into the aligned receiving surfaces of the top and bottom jaw members as shown in FIG. 3. The cue is thus held securely in place in that a simple knock in any direction other than directly in the direction of the mouth will ensure that the cue is held in place and cannot topple to the ground with the potential of damaging impacts. As the mouth is in the rear surface of the device facing away from the table impacts tend not to be in this direction. As the receiving surface is loose around the cue and the mouth has a width slightly greater than the width of the cue, there is no frictional engagement with the cue so there is little possibility for damage to the lobes surround the receiving surface and no marring of the cue.

The cue can be readily removed for use and replaced in its stored position when not in use.

When the player moves from a particular table, the player can readily grasp and remove the device simply by squeezing the exposed rear ends of the jaw members and can take the device to another table where the player may be playing next.

Figure 5:
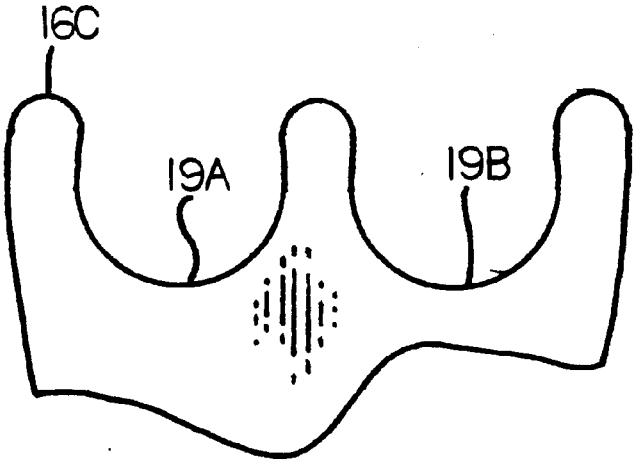
FIG. 5 is a top plan view of one part of a modified cue rest which is of increased width in order to provide an area for two receiving surfaces against which two separate cues can be rested.

In FIG. 5 is shown a modified arrangement in which the rear surface 16C includes two receiving surfaces 19A and 19B which are substantially identical to those previously described. Such an arrangement therefore can be used for both of the cues of the two players at a table. The device is of course of increased width to accommodate the two receiving surfaces.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

I claim:

1. A cue rest for receiving a cue comprising:

a support member having a first side a first jaw member defining a first jaw surface for engaging said first side and an opposed second side;

a second jaw member defining a second jaw surface for engaging the second oppossed side of the support member;

the first and second jaw members being connected for relative pivotal movement about an axis parallel to the jaw surfaces so as to be movable from a clamping position for engaging the support member in a direction to increase the spacing between the jaw surfaces to a release position for releasing the support member;

a spring biasing the jaw members to the clamping position;

each jaw member having a manually engageable portion on a side of the pivot axis opposite to the jaw surface and arranged such that the jaw members can be moved to the release position by manual squeezing of the manually engageable portions;

and a generally U shaped receiving surface on at least one of the jaw members, the receiving surface thus including two sides, a base and an open mouth with the open mouth at one edge of said at least one jaw member for receiving and cradling a cue within the receiving surface.

2. The cue rest according to claim 1 wherein the receiving surface is in the manually engageable portion of said at least one of the jaw members.

3. The cue rest according to claim 1 wherein the manually engageable portion has a wall portion generally parallel to the jaw surfaces.

4. The cue rest according to claim 1 wherein the receiving surface is arranged in an edge of the at least one jaw member, which edge is generally parallel to the pivot axis.

5. The cue rest according to claim 1 wherein each of the jaw members has a receiving surface therein with the receiving surfaces being aligned.

6. The cue rest according to claim 1 wherein each jaw member comprises a substantially horizontal plate having the jaw surface at one end and the manually engageable portion at the opposed end and wherein each jaw member includes a pair of side walls extending at right angles to the plate, the side walls of one jaw member having overlapping parts relative to the side walls of the other jaw member for defining the pivot axis which extends between the overlapping parts parallel to the plates.

7. The cue rest according to claim 6 wherein the side walls are aligned with parts of reduced thickness overlapped.

8. The cue rest according to claim 6 wherein the plates are substantially identical in plan view and are aligned so that one directly overlies the other.

9. The cue rest according to claim 1 wherein the receiving surface forms an arc of a circle extending over an angle greater than 180°.

10. The cue rest according to claim 1 wherein the receiving surface has a layer of a resilient material.

11. The cue rest according to claim 1 wherein said at least one of the jaw members has two receiving surfaces arranged side by side for receiving two cues side by side.

* * * * *